United States Patent [19]

Mozley

[11] Patent Number: 4,799,920

[45] Date of Patent: Jan. 24, 1989

[54] MINERALS SEPARATOR

[75] Inventor: Richard H. Mozley, Falmouth, England

[73] Assignee: National Research Development Corporation, London, England

[21] Appl. No.: 51,648

[22] Filed: May 20, 1987

[30] Foreign Application Priority Data

May 22, 1986 [GB] United Kingdom ..... 8612498

[51] Int. Cl.[4] ..... B04B 11/00; B03B 5/32

[52] U.S. Cl. ..... 494/23; 209/445; 209/452; 494/37; 494/47; 494/55; 494/56

[58] Field of Search ..... 209/422, 434–436, 209/438, 439, 444, 445, 451, 452, 453; 494/23, 27, 29, 37, 47, 52, 55, 85, 56

[56] References Cited

U.S. PATENT DOCUMENTS

| | | | |
|---|---|---|---|
| 287,840 | 11/1883 | Mabry | 209/445 X |
| 436,133 | 9/1890 | Hellstrom | 494/47 X |
| 499,344 | 6/1893 | Peck | 494/47 X |
| 1,080,053 | 12/1913 | Finlay | 494/47 X |
| 2,184,598 | 12/1939 | Jahn | 494/27 |
| 2,424,367 | 7/1947 | Nicol | 209/445 U X |
| 2,837,272 | 6/1958 | Laguilharre | 494/27 |
| 3,069,016 | 12/1962 | Kiesskalt et al. | 494/47 X |
| 3,161,581 | 12/1964 | Tiedje et al. | 494/37 X |
| 4,608,040 | 8/1986 | Knelson | 494/27 |

FOREIGN PATENT DOCUMENTS

| | | | |
|---|---|---|---|
| 0140709 | 2/1950 | Australia | 209/445 |
| 80202 | 8/1982 | Australia . | |
| 1026693 | 3/1958 | Fed. Rep. of Germany . | |
| 1252022 | 12/1960 | France . | |
| 0724193 | 3/1980 | U.S.S.R. | 209/445 |
| 1215716 | 12/1970 | United Kingdom . | |
| 1576469 | 10/1980 | United Kingdom . | |

*Primary Examiner*—Johnny D. Cherry
*Assistant Examiner*—Edward M. Wacyra
*Attorney, Agent, or Firm*—Cushman, Darby & Cushman

[57] ABSTRACT

To separate minerals, they are made up into a slurry A applied to a hollow tapered cylinder 301 spinning on its axis to generate 10 g centrifugal force. The cylinder 301 is also subjected to axial vibration at 5 to 10 Hz. The cylinder widens at a half-angle of 1°, and its axis is inclined at 2° upwardly in the direction of widening. A film of slurry is held centrifugally to the internal surface of the cylinder and kept in suspension by the vibration. The denser (i.e. higher specific gravity) particles in the slurry tend to move preferentially radially outwardly (centrifugally) and to move downwardly in the boundary layer (under Earth's gravity). The action of the washing water B is to displace waste accidentally entrained with the higher-specific-gravity-particles. The valuable higher-specific-gravity particles overflow downwardly continuously at C and are collected. The washing water and lower-specific-gravity waste particles overflow upwardly over the top edge of the cylinder at C and are discarded.

23 Claims, 3 Drawing Sheets

MINERALS SEPARATOR

Figure 1:
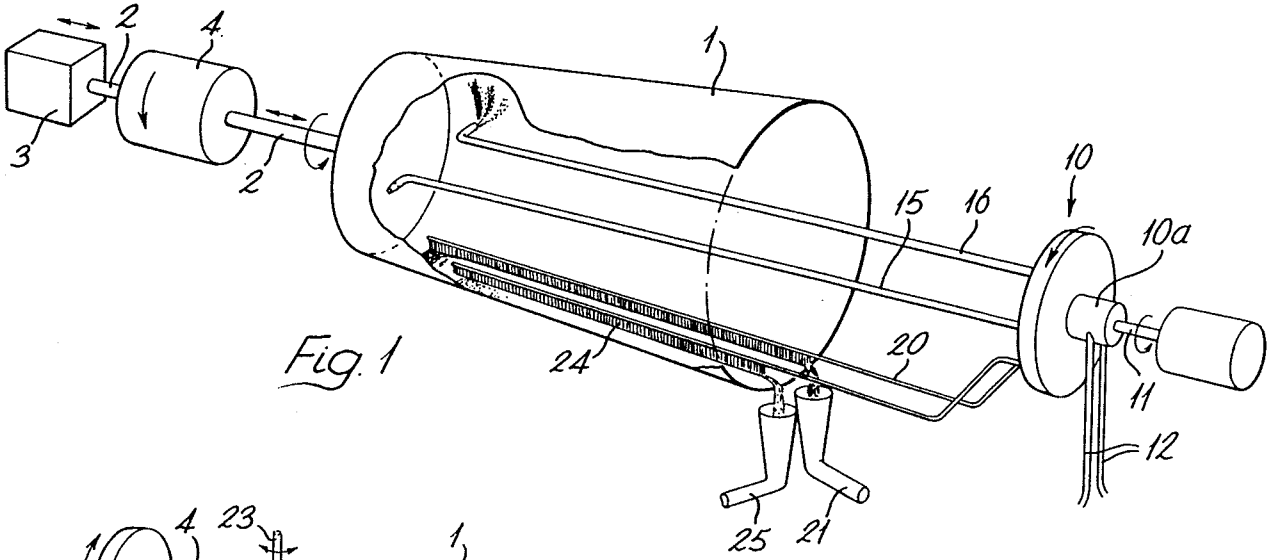

This invention relates to a minerals separator.

Minerals are conventionally separated on a shaking table. A slurry consisting of powdered minerals in water is supplied as a thin fluid film to part of the top edge of a gently sloping riffled table, which is shaken (with asymmetric acceleration) parallel to the top edge. Simultaneously, a film of washing water is applied to the rest of the top edge. The denser particles in the film move downhill more slowly than the lighter particles, but are shaken sideways faster than the lighter particles, and hence may be collected separately.

Accordingly to the present invention, a minerals separator comprises a body having a surface having the form of the inside of a cylinder (which may be tapered) arranged when rotating about its axis to have a force acting axially along it, means for rotating the body about the axis of the cylinder to apply a centrifugal force exceeding g to said surface, means for applying perturbations to the body or to particles held centrifugally to it, means for applying a slurry and means for applying washing liquid to the inside of the cylinder (preferably at the narrower end if it is tapered) and means for collecting separately fractions from different locations spaced axially along the cylinder (such as its opposite ends). The cylinder may be a right cylinder, or a frustum or otherwise tapered cylinder.

The invention also provides a method of separating minerals, comprising applying a slurry containing the mineral to the inside surface of a cylinder (i.e. including right cylinders, frusta or otherwise tapered cylinders) rotating to apply a centrifugal force exceeding g at the surface, perturbing the rotating surface, arranging the surface to have a force acting axially along it such as by a hydrodynamic pressure gradient, tilt or taper, applying washing liquid to the surface at such a location that said force tends to transport it past the slurry application point, and collecting separately slurry fractions according to their different mobilities axially along the cylinder.

The separate collections may thus be from axially different locations down the cylinder. such as from each end of the cylinder, preferably continuously.

The perturbations may take any one or more of several forms. For example cyclic variation of the rotation speed of the body such as momentary interruptions to, or accelerations and decelerations superimposed on, the rotation, or shaking to and fro symmetrically (e.g. sinusoidally) or asymmetrically along an axis (such as the axis of rotation) preferably such that particles adhering to the surface tend to be conveyed against said axial force, or an orbital motion (possibly in the plane normal to the axis of rotation). Other forms of possible perturbation include tilting the axis of rotation, whereby a particle held to the cylinder experiences an axial force varying cyclically every revolution, and vanes inside the cylinder and rotating with respect to it, so mounted as to force such a particle part-way towards the upper or narrower end. Axial shaking, tilting and vanes in combination are especially preferred. The tilting of the axis is preferably up to 45° to the horizontal such as ¼°-20° preferably ½°-6°. The vanes would be compatible with collection from both ends of the cylinder, and might be arranged to rotate with the cylinder at a rotational speed different from, but within 5% (preferably within 1%) of, the cylinder's speed; the vanes in such a version may be replaced by equivalent means, such as jets or curtains of liquid.

If the cylinder is tapered, the half-angle of the frustum is preferably up to 45°, such as ½° to 10° e.g. ½° to 20°. The speed of rotation of the frustum or other cylinder is preferably such as to generate a centrifugal force of from 5 g to 500 g, and it will be appreciated that with such centrifugal force, the rotation axis can be vertical, horizontal or at any angle, with (at any non-vertical angle) a useful contribution from Earth's gravity in cyclically perturbing particles held centrifugally.

In all cases, washing liquid is preferably applied intermittently or more preferably continuously to the surface such that said axial force tends to transport it past the slurry application point. The washing liquid is for the purpose of improving the grade or cleanness of the heavy mineral in the radially outer layers, or for assisting removal of material either by virtue of the pressure of the liquid, or when the applied centrifugal force is reduced.

In collection separated materials may be collected separately yet at the same end of the cylinder, optionally with assistance by washing liquid, by a plurality of blades each extending axially from an end of the cylinder to a respective desired location, the blades and slurry applicator being arranged to rotate with the cylinder at a rotational speed different from, but within 5% (preferably within 1%) of, the cylinder's speed; the blades in such a version may be replaced by equivalent means, such as jets or curtains of liquid.

The means for rotating the cylinder may be a motor-driven shaft, on which a plurality of the tapered cylinders may be mounted, for example nested outwardly from the same point on the shaft, or spaced axially along the shaft, or both. Ancillary apparatus (such as the slurry feed means) is duplicated appropriately. Material to be treated may be arranged to travel through the plurality of cylinders in series or in parallel or partly both.

In another preferred version, the invention is a mineral separator comprising a hollow cylinder rotatable about its axis, which is vertical. The cylinder has an inward lip, curve or taper to its lower edge. The minerals separator has means for applying a slurry of the mineral to be separated to the inside of the cylinder and for applying washing liquid to the inside of the cylinder between the lip and the slurry application point. The cylinder has means for perturbing it (preferably circumferentially) sufficiently to keep the slurry in suspension.

The invention in a related aspect is therefore separating minerals by applying a slurry of them to the inside of a hollow spinning vertical-axis cylinder with an inward lip, curve or taper to its lower edge. The cylinder is perturbed enough (preferably circumferentially) to keep the slurry in suspension, and washing liquid is applied to it between the slurry application point and the lower edge. The heavy fraction of the slurry is removed either (i) continuously from the lower edge, or (ii) by removing the light fraction and (a) under gravity, optionally assisted by flushing liquid, or (b) mechanically, collecting the heavy fraction.

Figure 2:
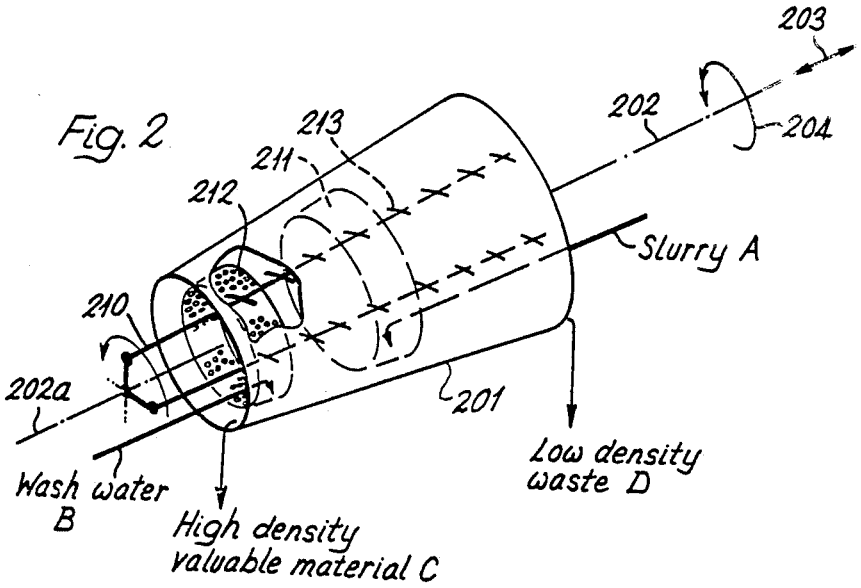
Figure 3:
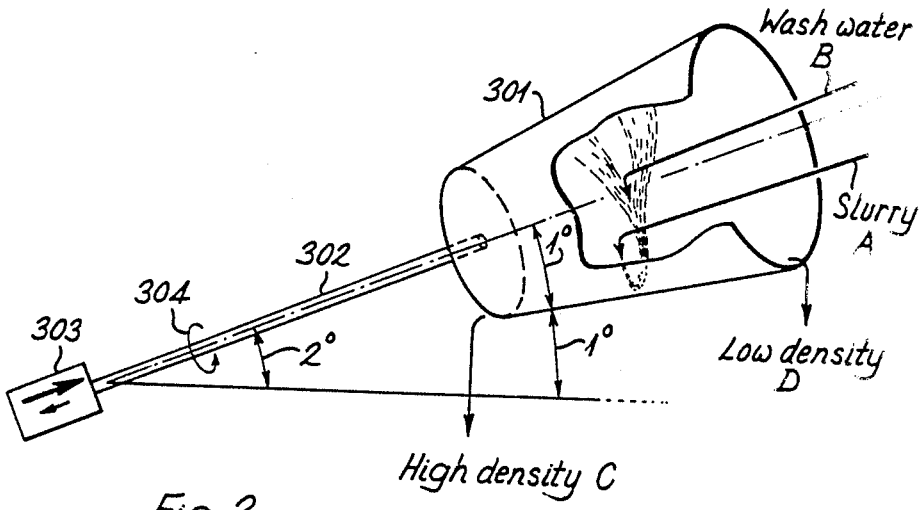

The invention will now be described by way of example with reference to the accompanying drawings, in which FIGS. 1, 2 and 3 are schematic views of three different minerals separators according to the invention.

Figure 4:
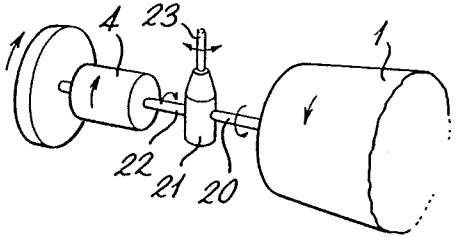
Figure 5:
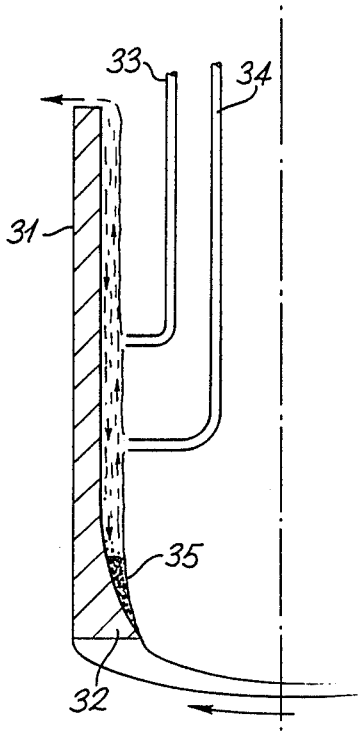

FIG. 4 is a schematic view of part of a minerals separator according to the invention, with an alternative drive system, and FIG. 5 shows a minerals separator according to another preferred version of the invention.

In FIG. 1, a minerals separator has a hollow body 1, shown as if transparent, whose inside surface is a frustum. The body 1 is open at its wider end and mounted axially at its narrower end on a shaft 2. The shaft 2 is reciprocated at 7 Hz, amplitude 1½ cm each side of rest, by a shaker 3 and rotated at 400 rpm by a motor 4. The body 1 has a frustum cone half-angle of 1°, an axial length of 30 cm and an average internal diameter of 30 cm. Larger cone angles are effective at higher rotational speeds.

Protruding into the body 1 through its open wider end is an assembly 10 of feed pipes and scraper brushes. The whole assembly 10 is mounted on a motor-driven shaft 11 and rotates together, in the same sense as the rotation of the shaft 2, but at 339.6 rpm. The assembly 10 is fed by stationary pipes 12 through a rotary coupling 10*a* with slurry and wash water. The slurry in this example comprises ground ore containing small amounts of valuable (high S.G.) material, the remainder (low S.G. material) being waste, with all particles finer than 75 microns, half finer than 25 microns and quarter finer than 10 microns, this ground ore being suspended at a concentration of 50 to 300 g, e.g. 150 g, per liter of water. The solids feed rate is kept at about 50 to 300 g/min, whatever the concentration of solids in the slurry. The slurry is fed at 1l/min to the narrower end of the hollow body 1 through a slurry feed pipe 16, and the wash water is fed through a pipe 15 slightly to the rear i.e. such that a slurry particle deposited into the body receives wash water a moment later. Instead of a single feed pipe 16, slurry can be fed over an arc of up to say 180° of the body. The wash water can likewise be fed over an arc. On the other side of the pipe 16 from the pipe 15 is a long generally axial scraper brush 20, which can remove matter from the whole of the inside surface of the body 1 to a collector schematically shown at 21. Between the brush 20 and the pipe 15, *opposite* the pipe 16, is a similar brush 24 but slightly shorter towards the narrower end of the hollow body 1. The pipes 15 and 16 and the brushes 20 and 24 are all part of the assembly 10. The shorter brush 24 can remove matter from the area which it sweeps, into a collector 25. The brushes 20 and 24 are suitably 90° apart (though illustrated closer, for clarity). In practice, the collectors 21 and 25 cannot be gravity-fed cups as they are shown for simplicity, since the whole assembly 10 is rotating. The collectors 21 and 25 could however be annular troughs disposed round the periphery of the open wider end of the hollow body 1, or otherwise adapted to collect (separately, from the brushes 20 and 24) material thrown out centrifugally from the body 1.

In use, slurry is fed through the pipe 16 to the narrower end of the axially-shaking fast-rotating body 1. Because the body rotates anticlockwise as drawn at 400 rpm while the assembly 10 rotates in the same sense at 399.6 rpm, the net effect is equivalent to a rotation of the assembly clockwise at 0.4 rpm inside the body 1. The slurry thus is shaken (by the shaker 3) while subject to several g of centrifugal force (instead of a mere 1 g of Earth's gravity) and separates into components of which the lightest move the most rapidly towards the wider end of the body 1. Increasing the shake speed had the effect of making even the denser particles more mobile.

After about 2 minutes, a given element of slurry fed from the pipe 16 will be enhanced-gravity shaken and separated into density bands down the body 1, and the brush 24 will engage all but the heaviest components of that element of slurry. The brush 24 (aided by wash water from the pipe 15 and from other pipes, not shown, nearer each brush) will remove everything it contacts, into the collector 25. About half a minute later, the heaviest component (i.e. the highest-density band, containing the metal values in all typical cases) is met by the longer brush 20 and washed off into the collector 21 for further treatment, The body 1, now brushed clean, then receives more slurry from the pipe 16, and the described process carries on continuously.

The shafts 2 and 11 may be driven from the same motor (instead of the separate motors described), with the shaft 11 being nonshaken and powered through a gearbox arranged for a small (e.g. 0.1%) rotational speed differential between the body 1 and the assembly 10). Whether the body or the assembly rotates the faster is an arbitrary matter of choice as long as the assembly is arranged to deliver slurry and to collect, separately, differentiated bands of slurry.

The separately collected bands of slurry may be further separated in similar or identical separators. For this purpose, or for separating parallel streams of slurry, or for both purposes, the similar or identical separators may be mounted on the same shaft, spaced axially, or nested radially outwards, or staggered (nested *and* slightly axially offset), or any combination of these.

In FIG. 2, a minerals separator shown in perspective has a hollow body 201, shown as if transparent, whose inside surface is a frustum. The body 201 is open for exit of fluid at both ends and mounted axially at its wider end (by means omitted for clarity), on a shaft indicated at 202. The shaft 202 is reciprocated at 7 Hz, amplitude 1½ cm each side of rest, by a shaker applying the motion 203 and rotated by a motor at 200 rpm in the sense 204. The motor is connected via sliding bearings to the shaft 202. The shaker acts evenly in each direction (sinusoidally), but shakers acting with a stronger impulse in one direction could be used. The shaft 202 is horizontal. The body 201 has a frustum cone half-angle of 1°, an axial length of 60 cm and an average internal diameter of 50 cm. Larger cone angles are effective at higher rotational speeds.

Protruding into the body 201 through its open narrower end is an assembly 210 of accelerator rings 211 and 212 and scraper vanes 213. The whole assembly 210 is mounted on a shaft 202*a* driven through a gearbox by the shaft 202 and rotates together, with the same shake and in the same sense as the rotation of the shaft 202, but at 192 rpm. The rings 211 and 212 are fed by stationary pipes with slurry A and wash water B respectively. The rings 211 and 212 impart a rotational speed to the slurry and water, which flow through perforations in the rings into the body at substantially the latter's rotational speed and well distributed circumferentially. The slurry in this example comprises ground ore from a classifier, containing small amounts of valuable (high S.G.) (usually small-sized) material, the remainder (low S.G. material) (usually larger-sized) being waste, with all particles finer than 75 microns, half finer than 25 microns and quarter finer than 10 microns, this ground ore being suspended at a concentration of 50 to 500 g, e.g. 300 g, per liter of water. The solids feed rate is kept at about 300 g/min, whatever the concentration of solids in the slurry. The slurry is fed at 1l/min to the ring 211 situated around the midpoint of the hollow body 201, and the wash water is fed at ½ l/min to the ring 212 situated at the narrower end of the body 201.

The vanes 213 are mounted on four equally spaced axial arms (only two shown) each carrying ten resiliently mounted soft plastics vanes 4½ cm long lightly touching the body 201 and angled at 30° to the circumferential direction of the body (recalling that the body 201 is rotating 8 rpm faster than the assembly 210 carrying the arms and vanes) so that matter in the body is forced towards the narrower end. The vanes on each arm are staggered with respect to the next arm, overlapping by about ½ cm, to maximise this effect.

In use, the slurry A is fed via the accelerator ring 211 to the midpoint of the axially-shaking fast-rotating body 201. Because the body rotates anticlockwise as drawn at 200 rpm while the assembly 210 rotates in the same sense at 192 rpm, the net effect is equivalent to a rotation of the assembly clockwise at 8 rpm inside the body 201. The slurry thus is sheared (by the motion 203) while subject to several g of the centrifugal force (instead of a mere 1 g of Earth's gravity) and separates into components of which the lightest tend to move faster towards the wider end of the body 201. Increasing the shake speed had the effect of making even the denser particles more mobile, but these normally tend to be pinned centrifugally to the body 201.

The vanes 213 disturb both the denser sessile particles and move them a few centimeters towards the narrower end of the body 201. The fluid and the lighter particles levitated by the shake/shear action, being more mobile, can continue to flow, past the advancing vane, towards the wider end, helped by the flow of wash water B. Immediately a given vane has receded, the denser particles will tend to 'stay put' while the water and the lighter particles will resume their motion towards the wide end of the body 201. Overall, the denser particles can be considered as being steadily swept, in many short stages, contrary to the axial force, towards the narrower end of the body 201, while the water and the lighter particles can be considered to make their way under the influence of the axial force induced by the taper of the cylinder despite the vanes towards the wider end of the body. The matter is thus sorted into valuable high density material C collected at the narrower end and low density waste D collected separately at the wider end. There could be instances where the low density material is valuable, perhaps even more valuable than the high density material, but it would still be separated in exactly the same way.

The shaft 202 and assembly 210 may be driven from separate motors (instead of the same motor described). Whether the body 201 or the assembly 210 rotates the faster is an arbitrary matter of choice as long as the vanes 213 are angled to direct matter pinned to the body generally towards the narrower end of the body 201.

The separately collected fractions of the slurry may be further separated in similar or identical separators. For this purpose, or for separating parallel streams of slurry, or for both purposes, the similar or identical separators may be mounted on the same shaft, spaced axially, or nested radially outwards, or staggered (nested *and* slightly axially offset), or any combination of these.

In FIG. 3, a minerals separator has a hollow body 301, shown as if transparent, whose inner surface is a frustum. The body 301 is open at both ends for exit of fluid and is mounted axially at its narrower end, by means omitted for clarity, on a shaft 302, inclined at 2° to 6° (say 2°) to the horizontal (greatly exaggerated in the Figure). The wider end of the frustum faces upwardly, even its lowest generator running upwardly, at an inclination of 1°, from narrower to wider end, this inclination thus opposing the axial force induced by the taper itself. The half-angle of the frustum is 1°.

An asymmetrically acting axial shaker 303 shakes the frustum through the shaft 302, with a sharper upward and gentler downward action. A particle on the surface of the frustum thus tends to stay still in space, by inertia, during the sharp upward stroke, but during the gentle downward stroke the particle tends to be held frictionally on, and thus to move as one with, the frustum. Continued asymmetric shaking in this fashion will thus tend to move such a particle progressively towards the narrower end of the frustum.

The frustum is rotated on its axis in the sense 304.

Slurry A is continuously applied near the middle of the frustum and wash water B is continuously applied at an axially similar but circumferentially displaced location. The slurry forms a film held centrifugally to the frustum but the axial shaking is sufficient to keep some of its constituents in suspension. Those constituents are not otherwise affected by the shaking. The denser constituents are however not kept in suspension and tend to be pinned centrifugally to the frustum subject to the asymmetric shaking action just described, tending to move them to overflow as a heavy-fraction stream C at the narrower end.

Meanwhile, the rotation, with the taper of the frustum, applies an axial force to the film of slurry suspension, acting towards the wider end. The water and the lighter particles, subject more to this force than the friction/shake action, tend therefore to flow towards the wider end as a low-density stream D, this stream (in normal mineral procession) being the waste.

FIG. 4 shows a drive system for the minerals separator, providing an alternative to shaking the shaft 2 of FIG. 1 and corresponding shafts of other Figures; a different perturbation is applied to the body 1 but the separation proceeds otherwise identically as described in relation to FIG. 1. In FIG. 4, the body 1 is mounted on a half-shaft 20 of an automotive-type differential unit 21. The other half-shaft 22 is powered by the motor 4, which is assisted by a flywheel. The 'propeller shaft' 23 is a shaft which is oscillated. The oscillations add accelerations and decelerations to the rotation supplied via the half-shaft 22 and reversed by the differential unit 21, in other words the body 1 may be regarded as rotating steadily with superimposed circumferential oscillations.

In FIG. 5, a hollow vertical-axis cylinder 31 is set spinning about its axis. The internal diameter being 0.3 to 3.0 m and the speed of rotation being a modest 50 to 100 rpm, a centrifugal force of the order of 10 g radially outwardly is experienced at the internal surface. This is small enough to allow the Earth's g to have significant effect. The cylinder 31 is also subject to circumferential vibration at 5 to 10 Hz. At its lower edge, the cylinder 31 is formed with an inwardly curved lip 32, of radial extent 1 to 10 mm. The lip could alternatively be a sharp flange, at 90° or otherwise to the cylinder wall. Instead of a welldefined lip, the lower edge may be 1 to 10 mm radially inwards of the upper edge, the intervening cylinder wall being straight (i.e. tapered), curved (e.g.

parabolic) or partly both, formed for example by centrifugally casting polymer resin.

A feed pipe 33 supplies slurry containing 100 g solids suspended per liter of water to approximately the mid-point (axially) of the cylinder 31. The solids are of the size distribution referred to earlier.

A feed pipe 34 supplies washing water to the internal surface of the cylinder, about mid-way (axially) between the feed pipe 33 and the lip 32.

As shown in FIG. 5 but grossly exaggerated in the radial direction, a film of slurry is held centrifugally to the internal surface of the cylinder 31 and kept in suspension by the vibration. The denser (i.e. higher specific gravity) particles in the slurry tend to move preferentially radially outwardly (centrifugally) and to move downwardly in the boundary layer (under Earth's gravity). The vibration, which is circumferential e.g. by the means of FIG. 4, has a shearing action tending to lift the lower-specific-gravity particles radially inwardly. The lip 32 promotes, at the radially inner surface, an upwardly acting hydrodynamic pressure gradient, which thus tends to carry the lower-specific-gravity particles (waste) with the bulk of the fluid flow. The lip 32 arrests the heavier particles into a band 35 on their downwards travel, thus both promoting the aforesaid pressure gradient and causing the higher-specific-gravity particles to overflow the lip 32 only after some recirculation and re-storing (assisted by the vibration). The action of the washing water from the pipe 34 is to displace waste accidentally entrained with the higher-specific-gravity particles.

The valuable higher-specific-gravity particles temporarily banked into the band 35 overflow downwardly continuously and are collected. The washing water and lower-specific-gravity waste particles overflow upwardly over the top edge of the cylinder 31 and are discarded.

I claim:

1. A minerals separator comprising:

a body having a surface having the form of the inside of a cylinder arranged when rotating about its axis to have a force acting axially along it;

means for rotating the body about the axis of the cylinder to apply a centrifugal force exceeding g to said surface;

means for applying perturbations to the body;

means for applying a slurry of minerals-to-be-separated to the inside of the cylinder;

means for applying washing liquid to the inside of the cylinder; and means for collecting separately fractions from different locations spaced axially along the cylinder comprising an assembly arranged to rotate within the cylinder at a relative speed therein which is small compared with the rotation speed of the body, the assembly and the body being equally subject to the perturbations and the assembly comprising a plurality of blade means each extending axially from an end of the cylinder to a respective desired location, at least some of the means for applying the slurry and the washing liquid being mounted on the assembly.

2. A minerals separator according to claim 1, wherein the cylinder is a frustum whose half-angle is up to 45°.

3. A minerals separator according to claim 2, wherein the half-angle of the frustum is ½° to 10°.

4. A minerals separator according to claim 3, wherein said half-angle is ½° to 2°.

5. A minerals separator according to claim 1, wherein the perturbations are applied by means imparting a cyclic variation of the rotation speed of the body.

6. A minerals separator according to claim 1, further comprising a shaker acting to and fro along the rotation axis of the body for applying the perturbations.

7. A minerals separator according to claim 1, wherein the rotation axis is horizontal.

8. A minerals separator comprising:

a body having a surface having the form of the inside of a cylinder arranged with rotating about its axis to have a force acting axially along it, the cylinder being a frustum having a half angle of ½° to 6° with the lowest generator of the frustum running upwardly from the narrower to the wider end of the cylinder at an inclination of ½° to 6° to the horizontal;

means for rotating the body about the axis of the cylinder to apply a centrifugal force exceeding g to said surface;

shaker means acting to and fro along the rotation axis of the body for applying perturbations to the body and acting asymmetrically such that particles touching the cylinder tend to be conveyed against said axial force;

means for applying a slurry of minerals-to-be-separated to the inside of the cylinder;

means for applying washing liquid to the inside of the cylinder; and means for collecting separately fractions from different locations spaced axially along the cylinder.

9. A minerals separator comprising:

a body having a surface having the form of the inside of a cylinder arranged when rotating about its axis to have a force acting axially along it;

means for rotating the body about the axis of the cylinder to apply a centrifugal force exceeding g to said surface.

means for applying perturbations to the body;

means for applying a slurry of minerals-to-be-separated to the inside of the cylinder;

means for applying washing liquid to the inside of the cylinder; and means for collecting separately fractions from different locations spaced axially along the cylinder comprising an assembly arranged to rotate within the cylinder at a relative speed therein which is small compared with the rotation speed of the body, the assembly and the body being equally subject to the perturbations, and the assembly comprising means for axially directing matter held centrifugally to the body, contrary to said axial force, in repeated steps each small compared with the axial length of the cylinder.

10. A mineral separator according to claim 9 in which the means for axially directing matter comprises vanes.

11. A minerals separator according to claim 9 wherein the cylinder is tapered and the direction of the axial action force is towards the narrower end of the cylinder.

12. A minerals separator according to claim 11, wherein the said different locations spaced axially along the cylinder are its opposite ends.

13. A method of separating minerals, the steps comprising:

applying with an applicator a slurry containing the mineral to the inside surface of a cylinder rotating to apply a centrifugal force exceeding g at the surface;

perturbing the rotating surface;

arranging the surface to have at least one force acting axially along it, and continuously collecting separately slurry fractions according to their different motions axially along the cylinder by blade means each extending axially from an end of the cylinder to a respective desired location, the blade means and the slurry applicator being rotated with the cylinder at a rotation speed different from, but within 5% of, the cylinder's speed.

14. A method according to claim 13, wherein the force acting axially along the cylinder is a hydrodynamic pressure gradient.

15. A method according to claim 13, wherein the force acting axially along the cylinder is induced by tapering the cylinder.

16. A method of separating minerals, the steps comprising:

applying a slurry containing the minerals to the inside surface of a cylinder rotating to apply a centrifugal force exceeding g at the surface;

perturbing the rotating surface;

arranging the surface to have at least one force acting axially along it;

applying washing liquid to the inside surface of the cylinder at such a location that said axially acting force tends to transport the liquid past the axial location of slurry application, continuously collecting separately slurry fractions according to their different motions axially along the cylinder, the rotation conditions of the cylinder being such in relation to the slurry's components that the denser fraction thereof is held centrifugally to the cylinder relatively immobile as the less dense fraction departs axially from it, permitting their collection from separate locations; and axially directing the denser fraction contrary to the axial force, in repeated steps each small as compared with the axial length of the cylinder.

17. A method according to claim 16, wherein vane means, rotating within the cylinder at a relative speed which is small compared with the rotation speed of the cylinder, direct its contents, in repeated steps each small compared with the axial length of the cylinder, in the opposite direction to that which the less dense fraction tends to take under the influence of said axial force.

18. A method according to claim 16, wherein the rotation axis of the cylinder is horizontal.

19. A method of separating minerals, the steps comprising:

applying with an applicator a slurry containing the mineral to the inside surface of a tapered cylinder rotating to apply a centrifugal force from 5 g to 500 g at the surface, the rotation axis of the cylinder being at up to 45° to the horizontal, the lowest generator of the surface running upwardly from the narrower to the wider end of the cylinder at an inclination of ¼° to 20° to the horizontal;

perturbing the rotation surface;

arranging the surface to have at least one force acting axially along it, and continuously collecting separately slurry fractions according to their different motions axially along the cylinder.

20. A method according to claim 19, wherein the perturbing is done by asymmetrically shaking the cylinder to and fro along its axis of rotation such that particles touching the cylinder tend to be conveyed against said axial force.

21. A method according to claim 19, wherein the inclination is ½° to 6°.

22. A method according to any of claims 13, 16 or 19, wherein the perturbing is done by shaking the cylinder to and fro along its axis of rotation.

23. A method according to claim 16 or 19, wherein the separate collections are two, one from each end of the cylinder.

* * * * *